US010906700B2

(12) United States Patent
Trollen

(10) Patent No.: US 10,906,700 B2
(45) Date of Patent: Feb. 2, 2021

(54) BARRIER DEVICE FOR STORING A WET PAINT APPLICATION DEVICE

(71) Applicant: Jonathan Edward Trollen, Cincinnati, OH (US)

(72) Inventor: Jonathan Edward Trollen, Cincinnati, OH (US)

( * ) Notice: Subject to any disclaimer, the term of this patent is extended or adjusted under 35 U.S.C. 154(b) by 0 days.

(21) Appl. No.: 16/285,551

(22) Filed: Feb. 26, 2019

(65) Prior Publication Data

US 2019/0185216 A1 Jun. 20, 2019

Related U.S. Application Data

(63) Continuation-in-part of application No. 14/859,573, filed on Sep. 21, 2015, now abandoned, which is a (Continued)

(51) Int. Cl.
*B65D 33/16* (2006.01)
*B65D 33/00* (2006.01)
(Continued)

(52) U.S. Cl.
CPC ..... *B65D 33/165* (2013.01); *B44D 3/125* (2013.01); *B65D 33/004* (2013.01); *B65D 33/30* (2013.01)

(58) Field of Classification Search
CPC .... B65D 33/165; B65D 33/004; B65D 33/30; B44D 3/125
(Continued)

(56) References Cited

U.S. PATENT DOCUMENTS 1,934,316 A 11/1933 Loomis
1,983,619 A 12/1934 Lent
(Continued)

FOREIGN PATENT DOCUMENTS

GB 1150037 4/1969
GB 2395897 6/2004
WO 9220596 11/1992

OTHER PUBLICATIONS

Plastic-Wrapped Paint Holder (http://www.rd.com/familyhandyman/article.do?siteId=1111&categoryId=6008&contentId=449) The Family Handyman Magazine (1 page) (Dec. 1, 2005).
(Continued)

*Primary Examiner* — Jes F Pascua

(74) *Attorney, Agent, or Firm* — Daniel F. Nesbitt; Hasse & Nesbitt LLC

(57) ABSTRACT

A flexible barrier sleeve device and method to temporarily store a wet paint roller between uses, to avoid cleanups between successive applications of paint, or other roller-applied coatings. The flexible barrier sleeve has combined water- and solvent-barrier properties. A twist-tie can provide a closure and sealing means, and a stiffening strip disposed along the outer lip of the sleeve facilitates forming an opening into the sleeve for ease of loading of the wet paint roller. The sleeve material has barrier properties sufficient to keep both water and organic solvents ("paint diluents") inside the closed and sealed barrier sleeve. The twist-tie provides a vapor-resistant seal, to minimize the loss of water and organic solvents from inside the sleeve through the sealed opening. The combined barrier properties of the sleeve material and vapor-resistant seal prevent the wet paint from drying on the enclosed roller, and allows the paint roller to be later removed in a condition ready for the next use. The barrier sleeve can be used to store the wet paint roller on or off the roller frame.

13 Claims, 9 Drawing Sheets

Related U.S. Application Data continuation of application No. 12/706,966, filed on Feb. 17, 2010, now Pat. No. 9,139,038.

(60) Provisional application No. 61/153,014, filed on Feb. 17, 2009.

(51) Int. Cl.
*B65D 33/30* (2006.01)
*B44D 3/12* (2006.01)

(58) Field of Classification Search
USPC ..... 383/33–35, 43, 63, 65, 105, 116
See application file for complete search history.

(56) References Cited

U.S. PATENT DOCUMENTS 2,080,402 A 5/1937 Herman
2,485,068 A 10/1949 Santana
2,533,829 A 12/1950 Merryweather
2,560,535 A * 7/1951 Allen ..... A24F 23/02 229/76
2,776,050 A 1/1957 Switzer
2,878,849 A 3/1959 Lingenfelter et al.
3,027,999 A 4/1962 Heroy, Jr.
3,167,178 A 1/1965 Saunders
3,204,855 A 9/1965 Boynton et al.
3,217,971 A 11/1965 Shvetz
3,310,166 A 3/1967 Mauthe
3,371,696 A 3/1968 Ausnit
3,398,825 A 8/1968 Flook, Jr. et al.
3,406,853 A 10/1968 McLeod
3,480,198 A 11/1969 Repko
3,565,738 A 2/1971 Kirkpatrick
3,674,135 A 7/1972 Simon
3,690,448 A 9/1972 Switzer
3,716,182 A 2/1973 Korn
3,744,211 A 7/1973 Titchenal et al.
3,828,389 A 8/1974 Heisler
3,850,298 A 11/1974 Jolly
3,889,871 A 6/1975 White
3,905,476 A * 9/1975 Foreman ..... B44D 3/121 206/361
3,955,670 A 5/1976 Buslik
3,974,960 A 8/1976 Mitchell
3,981,399 A 9/1976 Crouch
4,126,085 A 11/1978 Mowli et al.
4,174,597 A 11/1979 Mowli et al.
4,205,765 A 6/1980 May
4,267,768 A * 5/1981 Cieslak ..... B65D 33/30 383/70
4,363,345 A 12/1982 Scheibner
D270,134 S 8/1983 Stoute et al.
4,445,250 A 5/1984 Seidl
4,514,962 A 5/1985 Ausnit
4,549,657 A 10/1985 Martin
4,593,408 A 6/1986 Drobish et al.
4,609,107 A 9/1986 Martin et al.
4,630,311 A 12/1986 Bentson
4,709,400 A 11/1987 Bruno
D293,144 S 12/1987 Papke et al.
4,738,358 A 4/1988 Kehl
4,787,517 A 11/1988 Martin
4,802,576 A 2/1989 Kern
4,847,939 A 7/1989 Derencsenyi et al.
4,854,470 A * 8/1989 Ireland ..... B44D 3/123 220/697
4,936,817 A 6/1990 Runge
4,948,268 A 8/1990 Rutledge
4,967,903 A 11/1990 Kettle et al.
4,982,838 A 1/1991 Fitjer
5,032,188 A 7/1991 Kettle et al.
5,040,904 A 8/1991 Cornwell
5,044,774 A 9/1991 Bullard et al.
5,074,098 A 12/1991 Filipchuk
5,174,445 A 12/1992 Mull
5,178,274 A 1/1993 Long
5,184,896 A * 2/1993 Hammond ..... B65D 33/007 383/104
5,244,090 A 9/1993 Keith
RE34,477 E 12/1993 Cornwell
5,284,002 A 2/1994 Fowler et al.
5,308,666 A * 5/1994 Borchardt ..... C08L 23/06 428/35.2
5,440,853 A 8/1995 Engdahl
5,533,228 A 7/1996 Jarecki et al.
5,539,950 A 7/1996 Zar et al.
5,540,363 A 7/1996 Wilson
5,645,164 A 7/1997 Hocking
D382,083 S 8/1997 Skelton et al.
5,673,534 A 10/1997 Fowler
5,692,835 A 12/1997 Krajeski
5,788,378 A 8/1998 Thomas
5,806,984 A 9/1998 Yeager
5,830,119 A 11/1998 Chen
5,966,902 A 10/1999 Korycki
5,980,109 A 11/1999 Wan
6,079,878 A 6/2000 Yeager
6,086,524 A 7/2000 Martin
6,244,746 B1 6/2001 Tokita et al.
6,450,336 B1 9/2002 Edes
6,481,891 B2 11/2002 Yeager
6,530,470 B2 3/2003 Roundy
D484,315 S 12/2003 Braswell
7,344,022 B2 3/2008 Madson
7,364,361 B2 * 4/2008 Turvey ..... B65D 33/007 383/33
7,467,893 B2 12/2008 Sprehe
8,678,651 B2 3/2014 Schwallie et al.
9,139,038 B1 9/2015 Trollen
2002/0156419 A1 10/2002 Silver et al.
2005/0129338 A1 6/2005 Sprehe
2005/0145518 A1 7/2005 Hong
2006/0054527 A1 3/2006 Hart et al.
2006/0239594 A1 10/2006 Ishizaki et al.
2006/0280386 A1 12/2006 Bublitz
2007/0000800 A1 1/2007 Stoddart
2007/0031072 A1 2/2007 Gallardo et al.
2007/0062823 A1 3/2007 Anderson

OTHER PUBLICATIONS

Mr. Long Arm Brush & Roller Wrappers (http://www.mrlongarm.com/wrappers.html) (9 pages) (Feb. 5, 2008).

* cited by examiner

BARRIER DEVICE FOR STORING A WET PAINT APPLICATION DEVICE

CROSS-REFERENCE TO RELATED APPLICATIONS

This is a continuation-in-part application from U.S. application Ser. No. 14/859,573, filed Sep. 21, 2015 (pending), which is a continuation from U.S. application Ser. No. 12/706,966, filed Feb. 17, 2010 (issued as U.S. Pat. No. 9,139,038), which claimed the benefit of U.S. Provisional Application 61/153,014, filed Feb. 17, 2009, the disclosures of which are incorporated herein by reference.

BACKGROUND OF THE INVENTION

Some painting projects require several coats of paint over the course of several days, or possibly weeks. After a roller is used to apply paint, it must be discarded, or cleaned so that it is in good working condition for the next use. Discarding a roller after one use is expensive and wasteful. Cleaning a paint-covered roller is messy, time consuming, and generates undesirable cleaning by-products. The cleaning of wet paint rollers generates waste materials such as paint-laden water or organic solvent (generally, mineral spirits and turpentine), and paint and water or solvent-laden paper towels or rags. These cleanup materials add cost and generate waste going into the environment. Some people discard the wet roller, and use another one for the next painting. This generates multiple rollers which are discharged into the waste stream.

Cleaning a roller requires thorough rinsing with water or solvent depending on the base of the paint. If a paint roller is not cleaned completely, the remaining paint hardens on the roller, and it hinders or destroys the roller's ability to apply paint properly on its next use.

There are some references in painters' tips and handyman articles on the internet, for example, about rolling or folding up wet paint rollers in aluminum foil, in an attempt to preserve the water or solvent in the paint on the roller. There are many ways to wrap the roller up in foil, and these many ways are not air tight and do not significantly inhibit transfer of air and other vapors into and out of the foil. Thus, the water or solvent escapes, and the paint hardens on the roller. Paint can also leak out, causing a mess. Some paints can also corrode bare foil, creating holes, thereby allowing leakage as well.

Other references are found that recommend placing a wet paint roller in a polyethylene bag, and wrapping it up. Again, if an air-tight or leak-resistant seal is not made, water and solvent can leak out. Polyethylene, commonly used in sandwich bags, trash bags, grocery bags, and bread bags, provides a moderate barrier to water and moisture, but virtually no barrier to most organic solvents. Oil and solvent-based paints quickly lose their solvent through the polyethylene, and the paint hardens on the roller.

There are several brands of rigid plastic thermoformed clamshells being marketed to store wet rollers on roller frames. The roller frame/wet roller assembly is placed on one half of the clamshell, and the clamshell is then folded over and kept closed with a mechanical interlocking feature. They rely on a friction-fit mechanical interlocking feature, such as lugs, around their perimeter to remain closed. There is a hole in the clamshell which allows the roller frame's handle rod to extend beyond the clamshell. One problem with rigid clamshells is that roller frames have different shapes, and some do not conform to the rigid clamshell's recessed areas. The result is that the user cannot make the friction fit closure on some types of roller frames, because the roller frame interferes with the alignment of the friction-fit edges. The result is a partially closed clamshell that does not contain the water or chemical solvent in the paint. The paint is also free to leak out, causing a mess. The interlocking friction-fit method of closure, even when functioning correctly, is not vapor-tight, and the water and/or solvents leak out in a short period of time (1-2 days), allowing the paint on the roller to harden. Leakage also occurs around the hole that allows the roller frame to extend beyond the clamshell. The clamshell is made from hard plastic, and it does not conform (come into complete intimate contact) to the roller frame. Roller frames have handle rods that vary in size. Smaller diameter handle rods allow more leakage where they pass through the larger diameter hole in the clamshell. If the user wants to store the roller off the frame in a clamshell, the open hole provides a large passage through which moisture and/or solvent can escape quickly. Some commercial clamshells include a plug for the hole, some do not. The plugs provided are of the same hard plastic, and do not form an air-tight seal.

There are several rigid plastic and rigid metal containers that have met with little or no apparent commercial success. They typically teach using a rigid container to store a wet paint roller, and then eventually the container itself needs to be cleaned afterwards. By virtue of their sturdy design and higher cost, rigid containers are not generally viewed as disposable. The rigid container must be filled with water or solvent, and the paint-laden roller is to be submersed into it. This adds further mess and complexity, in that the water and solvent must be removed from the roller before it will evenly hold and distribute paint.

There remains a need for an inexpensive, disposable product to temporarily store a wet paint roller between uses, to facilitate the saving of time, money, and cleaning supplies, that conforms to all roller frame configurations, that provides a sufficiently vapor-tight or vapor-resistant seal, and that also works for roller storage on or off the roller frame.

SUMMARY OF THE INVENTION

The present invention provides a flexible barrier sleeve device and method to temporarily store a wet paint roller, on or off the roller frame, between uses, to avoid cleanups between successive applications of paint, or other roller-applied coatings. The flexible barrier sleeve is easy to use, economical and disposable, and has combined water- and solvent-barrier properties. A twist-tie or other closure means can provide a closure and sealing means. The closure means provides for at least an air-, moisture-, and solvent-resistant seal proximate the open end of the device. A stiffening means or strip disposed along the lip of the open end of the sleeve facilitates forming an opening into the sleeve for ease of loading of the wet paint roller. The sleeve material typically has barrier properties sufficient to prevent transfer of moisture and solvent through the sleeve, and to keep both water and organic solvents ("paint diluents") inside the closed and sealed barrier sleeve, so that the residual paint on the rollers remains moist and ready for use.

Typically, the flexible barrier device is made from a film with sufficient flexibility to allow clinging of the film to the wet roller, thereby minimizing air headspace in the sealed sleeve. The barrier material, minimal air headspace, and the moisture- and solvent-resistant seal provide a preferred means for containing the moisture and solvent in the residual paint on the wet roller, and keep the paint on the roller core from drying (that is, from losing solvent) and becoming thick or hard on the roller core.

This invention relates to a method and device for storing a wet paint roller on or off the roller frame. The device typically comprises a flexible barrier tube or sleeve with an opening and a closure means. Typically, a reinforced opening is also provided that assists the user by biasing open the sleeve's opening for insertion and removal of the paint roller. This reinforced opening reduces the mess of inserting a wet paint roller into a sleeve made of a soft, flimsy pliable material, where adhesion of the wet paint onto the surface of the material can overwhelm the integrity of the material, which collapses onto the wet roller.

The flexible barrier sleeve can consist of an open-ended tubular sleeve, typically consisting of confronting front and back film panels that are attached together partially around their perimeter, to define a container space therein, with an open end into which the wet paint roller core is inserted into the container space. The sleeve material provides an impermeable barrier to both water and organic solvents that are commonly used as paint diluents. These combined barrier properties work for multiple types of diluents, and significantly retard or stop the evaporation of water and organic solvents, thereby keeping them contained within the residual paint on the roller core, and within the barrier sleeve. The barrier material is typically about 20 mil thick and less, more typically less than 10 mil thick and less, even more typically less than 4 mil thick and less, and at least about 1 mil thick. The thinner material can be compressed and twisted tightly around the rod of a typical paint roller frame, and pressed and returned in intimate sealing contact with the rod. Residual paint that can rub off the roller and onto the inside of the sleeve enhances the seal. The thinner film material is typically more flexible and pliant, effecting intimate contact with the handle rod, or compression of the material itself without the rod, to form a more vapor-tight seal. The thinner film material also conforms and clings more readily to the wet paint roller core, thereby making it easier to reduce the amount of headspace left in the sealed barrier sleeve. A thicker film material may not conform to the rod as well, but is suitable, particularly when the roller is stored off the frame. Such barrier sleeve typically can be folded flat, and when used can be conformed into a near cylindrical shape for insertion of the roller. A preferred barrier film material comprises a layer of metalized polyester laminated to a heat sealable film material, such as a polyethylene film.

The device also comprises at least a vapor-resistant seal means that can form a seal between the container space and the open end. In a typical embodiment, the seal is made by joining the inner surface of the confronting barrier film panels to one another, or by compressing the film panels to the rod of the paint frame in on-the-frame storage. The closure means can comprise a portion of or be integral with the open-ended sleeve, such as an adhesive seal or mechanical seal means along its edge. The closure means for effecting the seal can be a friction fit mechanical interlocking feature, such as a plastic press-to-close zipper seal (referred to hereafter as a plastic zipper). The closure means can also comprise an adhesive closure means affixed to the inner surface of the barrier sheet, preferably using an adhesive with moisture and solvent barrier properties, for adhering the barrier sheet to the confronting panel. The seal means can be reclosable, resealable, and/or self-sealing, one or more times without loss of the effectiveness of the seal means to inhibit and prevent vapor transfer. The seal can also be made by folding over a portion of the open end of the barrier sleeve, and clamping the fold. A plastic press-to-close zipper usually functions adequately for off-the-frame use and storage, unless the entire roller and frame in enclosed within a suitably sized barrier sleeve or pouch. A vapor-proof seal is generally achievable when storing the paint roller off-the-frame.

In on-the-frame storage, where the rod and handle of a roller frame protrudes from the open end of the sleeve, the vapor-resistant seal is formed around the outside of the rod or other surface of the frame, to compress and seal up channels that can allow leakage of diluent and vapors. The film material on the open end is squeezed together and twisted, and a closure is applied around the twisted film material, and is cinched or twisted tight, to provide the seal. The invention contemplates the use of a compression seal means as a separate seal means that is manipulated against the outer surface of the film layers near the opening of the sleeve, to form the seal against the frame rod. Typical separate compression seal means include a wire tie, a twist tie, a zip tie, a clamp, and a hinged clip. The compressing force from a wire tie or other separate compression seal means can create intimate contact between the barrier material and the rod of the roller frame, thereby preventing transport of vapor through the channels formed between the film and the frame rod. In addition, any paint from the roller that might be rubbed off onto the inside surface of the material acts as a caulking or sealing agent, to enhance the seal properties. The closure can also be used to seal the open end of the barrier sleeve when storing the paint roller off the roller frame. The seal means used when the roller is stored on the frame is typically a vapor-resistant seal, to minimize the transfer of vapor from passing in or out of the container space through the seal means.

The end result is that when the barrier sleeve material and closure means are applied, the paint on the roller retains its solvents or diluents, and does not dry out or harden for weeks or months. Another desirable property of the barrier sleeve is that it is inexpensive and not costly to discard or dispose of after use, which adds to the convenience of the device.

In an alternative embodiment, a means for biasing open the opening end of a barrier sleeve can be provided. A typical biasing means is one or a pair of resilient strips that are applied laterally on the opposed sides of the open end of the sleeve, to make it easier to hold open the opening end of the sleeve while inserting the roller, with less mess and waste. One such embodiment uses resilient plastic strips sealed or extruded to the outer edges or lips of the open end. The plastic strips can have a layer of polyethylene or other heat seal material that allows them to be heat-sealed to the inside or outside surface of the sleeve film. Other methods of reinforcement considered are paper strips, metal strips, or metal or plastic wire.

An alternative embodiment of the invention comprises a cylindrical film sleeve comprising a pair of confronting plastic film layers sealed around their periphery, having a first closed end and an opposed second end, and comprising a twist-tie formed adjacent to and integrally with the closed end, and having a means for separating the twist-tie from the closed end. The twist-tie comprises at least one wire disposed between the confronting plastic film layers at the closed end. The at least one wire provides the separated twist-tie with sufficient flexibility and pliancy to be manipulated into a bent or curved shape, but with minimal or no resilience so as to avoid springing back to its prior shape after bending. The separating means is typically a tear line, such as a line of perforations.

An invention of the present application includes a film sleeve including a pair of confronting film layers sealed around a portion or all of their periphery, having a first end and an opposed second end, and comprising a twist-tie formed adjacent to and integrally with the first end between the confronting film layers, and having a means for separating the twist-tie from the closed end. The first end twist-tie comprises at least one wire. The at least one wire provides the separated twist-tie with sufficient flexibility and pliancy to be manipulated into a bent or curved shape, but with minimal or no resilience so as to avoid springing back to its prior shape after bending. The separating means is typically a tear line, including a score line and a line of perforations. The tear line can be formed within the sealed periphery of the first end, whereby when the twist-tie is separated, the first end remains a sealed end, or can be formed inboard of the sealed periphery, whereby when the twist-tie is separated, the first end becomes an open end. The second end can be an open end, which can be closed using the twist tie, or can be closed by the sealed periphery to form a closed end. The film can be a plastic film, a metalized plastic film, a metal film or foil, and laminates thereof, and can be a barrier, impermeable barrier, or non-barrier film.

In alternative embodiments of the barrier sleeve, the sleeve shape can be non-cylindrical, and typically tapering along its sidewall outward toward the open end of the sleeve, to facilitate insertion of the end of the paint roller into the sleeve. It is also within the scope of the present invention to provide a barrier device that provides a tubular barrier material that is sealed at each longitudinal end, and has an opening along the length of the tubular shape, for insertion transversely into the roller.

In another embodiment, the barrier device comprises a thermoformed or blow molded tubular sleeve having a closed first end for forming a cylindrical container space, and an opposed open formed end. The material of the thermoformed, blow molded, or injection molded tubular sleeve has sufficient rigidity and shape memory to maintain normally a cylindrical shape. Typically the open end has a circular opening defined by a rim of thicker material that has sufficient rigidity and shape memory to maintain a circular opening of the open end. The device is typically sealable near the open end to enclose the container space, typically by rotating the rim to seal off the sleeve inboard of the rim relative to the cylindrical body of the sleeve, in a manner similar to an iris valve.

Another alternative embodiment provides a barrier sleeve having an area identified for writing information, providing for example a means of identifying the paint contents. It is useful to be able to identify the type or brand of the paint on the roller stored in the barrier sleeve. One way is to print an identification block (ID block) of ink on the sleeve that can be written upon. The user records the paint color, date, and other details on the ID block with pen or pencil. The ink surface must be receptive to ink and pencil, allowing them to wet out and adhere to the surface. Another way to allow partial identification is by allowing the color of the paint to be visible through the barrier sleeve. This can be accomplished by using material with a small void in the metalization, or using a clear barrier material as defined in this writing.

In a typical method of using the invention, the paint roller is used, stored wet in the sleeve, and re-used and re-stored until the painting project is completed. After final use, the wet roller can be cleaned, or can be placed in the open sleeve, and allowed to dry out. The sleeve is then re-sealed with the seal means. The spent roller and sleeve are solid waste, which are discharged together into the waste stream. The use of a barrier sleeve eliminates the need for multiple rollers to do a painting project, and also eliminates the need for cleaning the roller after each use, which eliminates the generation of paint-laden water or solvent.

The harrier sleeve, made with a thin barrier film that is impermeable to moisture and solvent, clings in intimate contact to the wet outer surface of the wet paint roller, which helps the user in forcing out any residual air within the container space within which the paint solvent might evaporate, and minimizes the amount of outside oxygen that might transfer into the closed sleeve to interact with the paint.

The method also includes the step of forming an effective seal against the transfer of moisture and solvent from within the container space, to the outside, typically through the open end. When using mechanical sealing means, the effectiveness of the seal is improved by twisting the open end of the sleeve tightly around the roller frame, and by wrapping the mechanical seal, such as the twist-tie, tightly around the sleeve and roller frame rod, to effect the seal. Any paint that comes off the roller during insertion into the sleeve can also enhance the seal The present invention also provides a method of using the barrier devices described herein for storing a wet paint or solvent roller for extended periods of time (from weeks to months) between usages. The barrier properties of the barrier film that provides an impermeable barrier to moisture and solvent, and the seal means, provide a container within the device during storage, from which moisture and solvent vapor transmission is very low. These enable the storage of wet paint rollers within the device for weeks to months of time without hardening or thickening of the residual paint.

The devices and methods of the present invention are employed when a painter, having completed the use of the paint roller for applying paint to a surface, desires to temporarily stop the painting job, or has completed the painting job and wishes the store the paint roller for weeks or months.

DETAILED DESCRIPTION OF THE EMBODIMENTS

Definitions

As used herein the term "paint" means any fluid coating that can be applied with a paint roller, including paints, stains, sealer coatings, lacquers, and other coatings. They are comprised of color pigments, resin binders, and diluents.

As used herein the term "diluent" means water or one or more organic solvents such as mineral spirits, turpentine, alcohol, acetone, toluene, and other liquid components such as propylene glycol. Diluents keep the paint fluid through the application phase. Diluents evaporate after the paint is applied, leaving the paint to solidify and set up.

As used herein the term "cleanup materials" means any materials used to clean a paint roller between uses, including water or organic solvents used to rinse paint from the roller, paper towels or rags used in cleaning or drying the water or organic solvent.

As used herein the term vapor-"resistant" seal means a seal which inhibits the transfer of moisture or solvent vapors through the sealed point or line, at ambient or slightly elevated temperatures and pressures. The slightly elevated temperature can range up to about 120 OF (49° C.), and the slightly elevated pressure can range to up 1.1 atmospheres, caused primarily by solvent vapor pressure. An example of a vapor-resistant seal is one made by gathering and compressing the sleeve material around the handle rod of a roller, forming small and tortuous pathways along the seal that allow more vapor transfer therethrough than does the barrier film itself associated with the device.

As used herein the term vapor-"tight" or vapor-"proof" seal means a seal which prevents the transfer of moisture or solvent vapors through the sealed point or line, at ambient temperatures and pressures. An example of a vapor-tight seal is an adhesive or press-to-close zipper, where there is no physical opening. Such a seal can allow more vapor transfer through the seal body itself and seal members themselves than does the barrier film associated with the device.

As used herein, the term "impermeable barrier" relates to a barrier film material that has the moisture transmission rate of about 1.0 grams/100 square inches/24 hours (15.5 $g/m^2 \cdot 24$ hr), and less, and a solvent transmission rate is about 4.0 grams/100 square inches/24 hours (62 gm/m2·24 hr), and less, where the solvent is mineral spirits.

Figure 1:
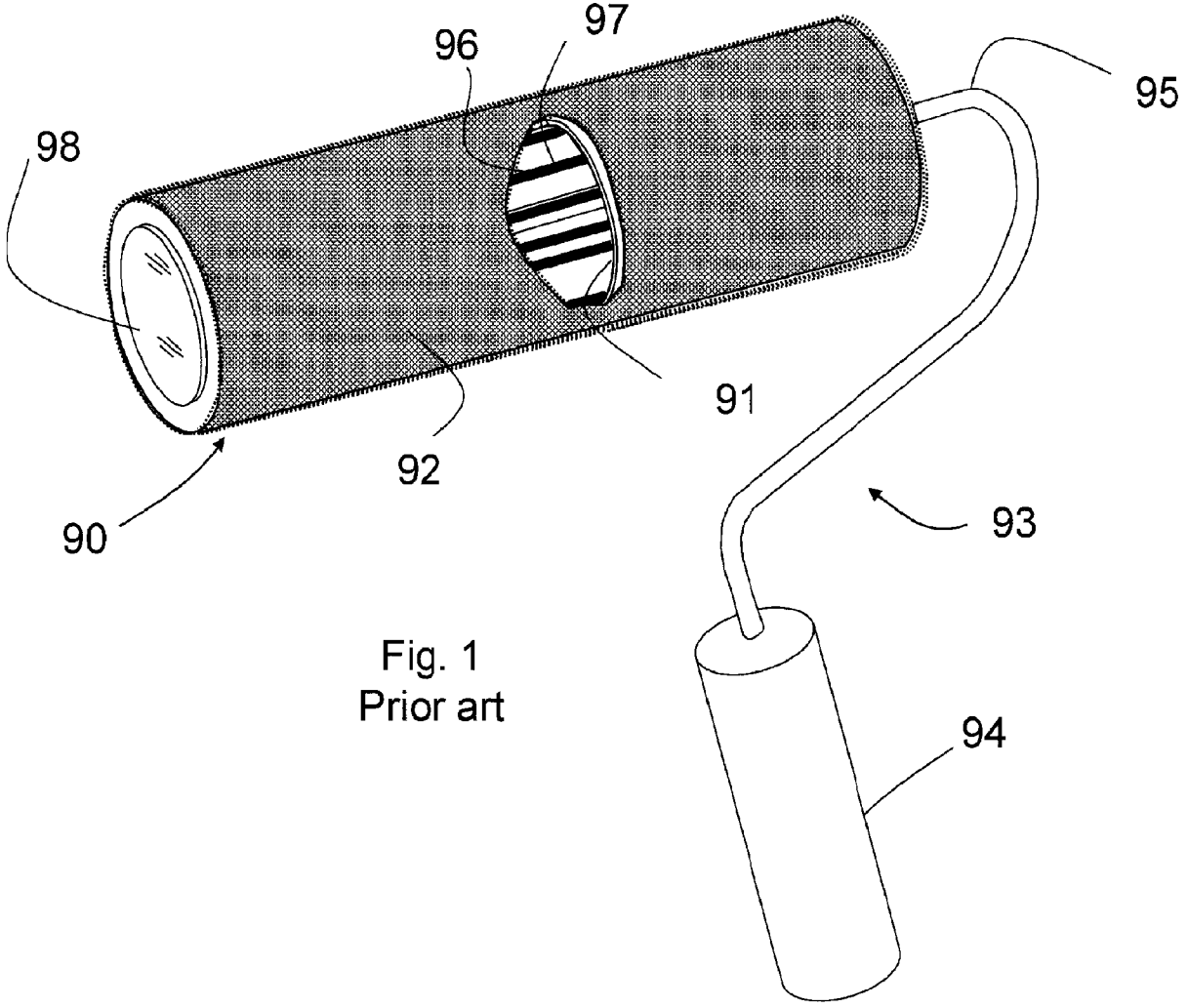
Fig. 1 Prior art
FIG. 1 shows a paint roller disposed on a paint roller frame of the prior art.

FIG. 1 shows a typical paint roller 90 on a roller frame 93 as a paint application device of the prior art. The paint roller 90 consists of a cylindrical paper or plastic core 91 and a covering 92 of an absorbent textile or polymer nap that adsorbs and applies paint when rolled against a continuous surface. The roller frame 93 is a well-known device used to hold the paint roller that allows the paint roller to roll freely against a surface being painted. The roller fi me 93 typically consists of a handle 94, a rotating roller support cage 96, and a handle rod 95 that connects the handle 94 to the roller support cage 96. The support cage 96 typically consist of two plastic end caps 98 that revolve freely, and support wires 97 that interconnect the two plastic ends. The roller cage 96 supports and retains the painter roller 90 by means of a forced frictional fit of the roller over the support wires 97 and the end caps 98. Typical paint rollers re about 3 inches, 9 inches, and 16 inches in length.

Figure 2:
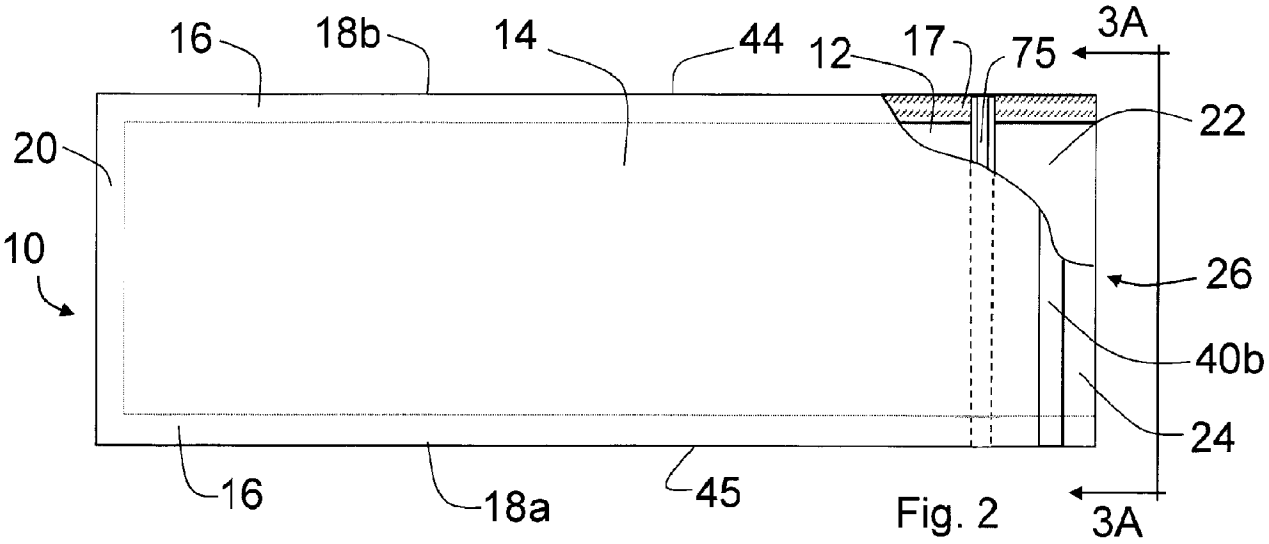
FIG. 2 shows a plan view of a rectangular flexible barrier sleeve according to the invention.

FIG. 2 shows a plan view of a rectangular flexible barrier sleeve 10 comprising a back panel 12 and a confronting front panel 14 that are joined around the periphery along the two long sides 18 (18*a* and 18*b*) and the closed end 20 to form a contained space having an open end 26. The front and back panels can be distinct sheets, or a single sheet folded over itself along one long side. The joined panels can be joined by A side seal 16 formed between the confronting panels, typically by thermally bonding the confronting inner heat seal layers of the two panels to form a flange 17. Alternatively, the sides of the panels can be overlapped (with the inner surface of one panel overlapping the outer surface of the other panel) to form a continuous side surface. The back panel 12 and the front panel 14 have corresponding lip portions 22 and 24 proximate the open end 26. In a preferred embodiment, the sleeve has a ratio of the length r, (the longitudinal dimension from the open end to the closed end) to the width (at the open end) of about 3-5:1, and more typically about 1.5:1.

Figure 3B:
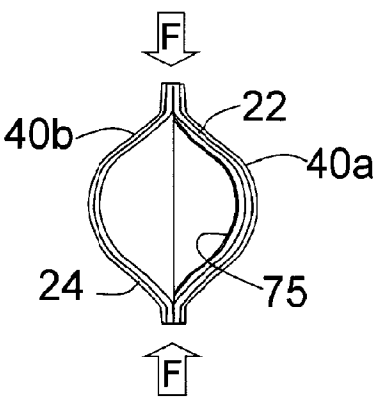
FIG. 3B shows the end view of FIG. 3A after forces are applied against the ends of stiffening members affixed to the open end of the barrier sleeve.
Figure 3A:
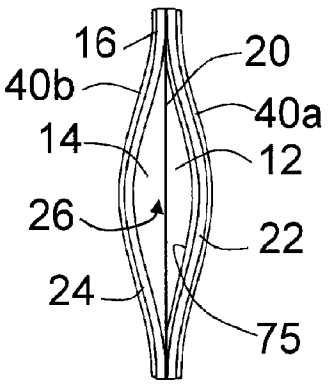
FIG. 3A shows an end view of the open end of the barrier sleeve of FIG. 2, viewed from line 3A-3A.

FIGS. 2 and 3A also show stiffening means 40*a* and 40*b* attached to lip portions 22 and 24, just inboard of the open end 26, as a means to facilitate forming a circular opening for inserting the wet paint roller. The stiffening strip is typically a linear material that has sufficient flexibility and pliancy to be manipulated into a bent or curved shape, but with sufficient resilience and shape memory to bias back toward its original linear shape. The reinforcing strip can be made from one or more of the following non-limiting list of materials: paper, polypropylene, polyester, high density polyethylene (HDPE), aluminum foil, and a metal. The strip can also be a rod, wire, flat band, or any other linear shape. The reinforcing strip can be adhered to a lip edge of the barrier sleeve opening, or formed into the lip edge with a sandwiching sealant layer, using an adhesive means or a sealant layers selected from the group consisting of polyethylene (PE), ethyl vinyl acetate (EVA), amorphous polyester, ionomer, acid copolymer, polypropylene film, pressure-sensitive adhesive, and pressure-sensitive adhesive tape, and combinations thereof. The stiffening means can also be integral with a sleeve made from a material having stable twist retention and dead fold properties that can retain a shape to which it is formed.

A means 75 for sealing the opening is disposed inboard from the open end 26 along the inner surfaces of the front and back panels 12 and 14. The sealing means 75 is illustrated in FIG. 3A as a plastic zipper seal. A first portion of a plastic zipper seal is affixed to the back panel 12 to engage and seals to the mating portion affixed across the width of the front panel 14, to form the seal against vapor transmission toward the open end 26. The seal means is disposed along the width between the sealed flanges 17 of the lateral sides 18*a* and 18*b*.

FIG. 3A shows the end view of the barrier sleeve 10, looking in through the open end 26. Stiffening means can be attached to the outside surfaces, respectively, of the back and front panels 12 and 14, although these can alternatively be affixed to the respective inside surfaces. In FIG. 3A, the stiffening means 40*a* is shown attached to the inside surface of the lip portion 22 of the back panel 12, while the stiffening means 40*b* is shown attached to the outside surface of the lip portion 24 of the front panel 14. FIG. 3B shows how the open end 26 of the device 10 is opened by applying force F onto the opposed lateral edges of the opposed ends of the stiffening means 40*a* and 40*b*. The stiffening means are illustrated as elongated strips of resilient material, typically made of plastic, and having shape memory, that are attached to the outer or inner surface of the lips 22 and 24. The stiffening means are illustrated as extending to the side edges 44, 45, though they can alternatively extend to a position inboard of the edges within the seal 16. Other stiffening means can include a stiff wire, a hardenable material including a hardening adhesive, glue or resin, and a plurality of wires or strips, and can be secured to the panels 12 and/or 14 with an adhesive or other fastening means. The stiffening means flex or bow outward as their ends are compressed toward one another, such that the lip portions attached to the stiffening means also bow outward to widen the opening of the open end 26.

Figure 4:
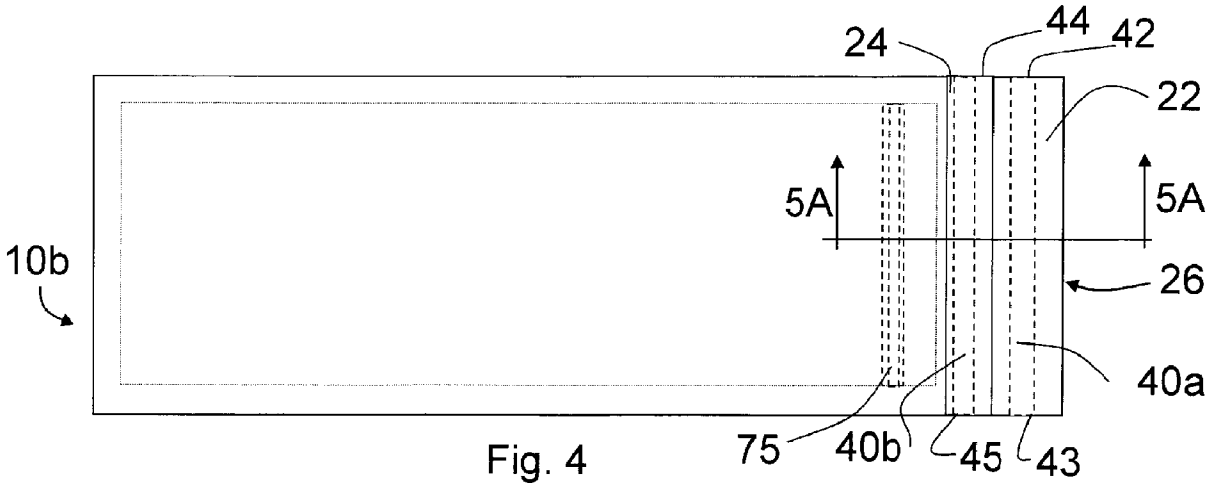
FIG. 4 shows a plan view of an alternative embodiment of the barrier sleeve, having un-attached edges at the open end.
Figure 5B:
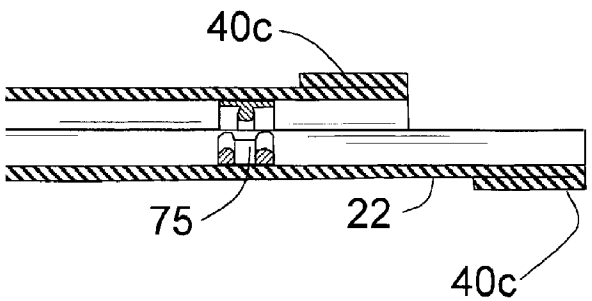
FIG. 5B shows a cross-sectional view of a barrier sleeve, where the film is overlapped to form the stiffening members.
Figure 5A:
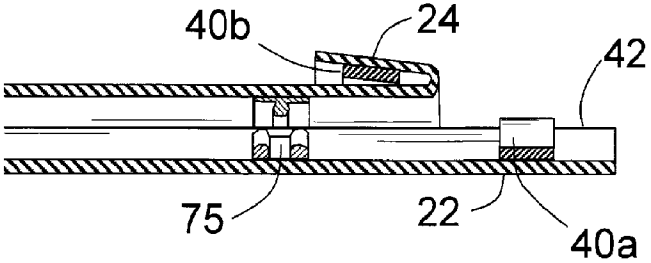
FIG. 5A shows a cross-sectional view of the barrier sleeve of FIG. 4 taken through line 5A-5A.

FIGS. 4 and 5A show another alternative embodiment of the barrier sleeve device 10, where the side edges 42 and 43 of the lip 22 of back panel 12 are not affixed to the corresponding side edges 44 and 45 of the lip 24 of the front panel 14. In the illustrated embodiment, the lip 24 is shorter in length (longitudinally away from the open end) than the lip 22 of the back panel 12. This aids separating and peel apart the two lips when initially manually opening the open end of the sleeve. This configuration allows the lip portions 22 and 24 to be folded outwardly (or inwardly) against the respective back and front panels. This configuration helps to isolate the inner surfaces of the lip portions from the wet roller as it is inserted into and withdrawn from the sleeve device 10, to prevent fouling of the surfaces with paint or solvent.

Figure 19:
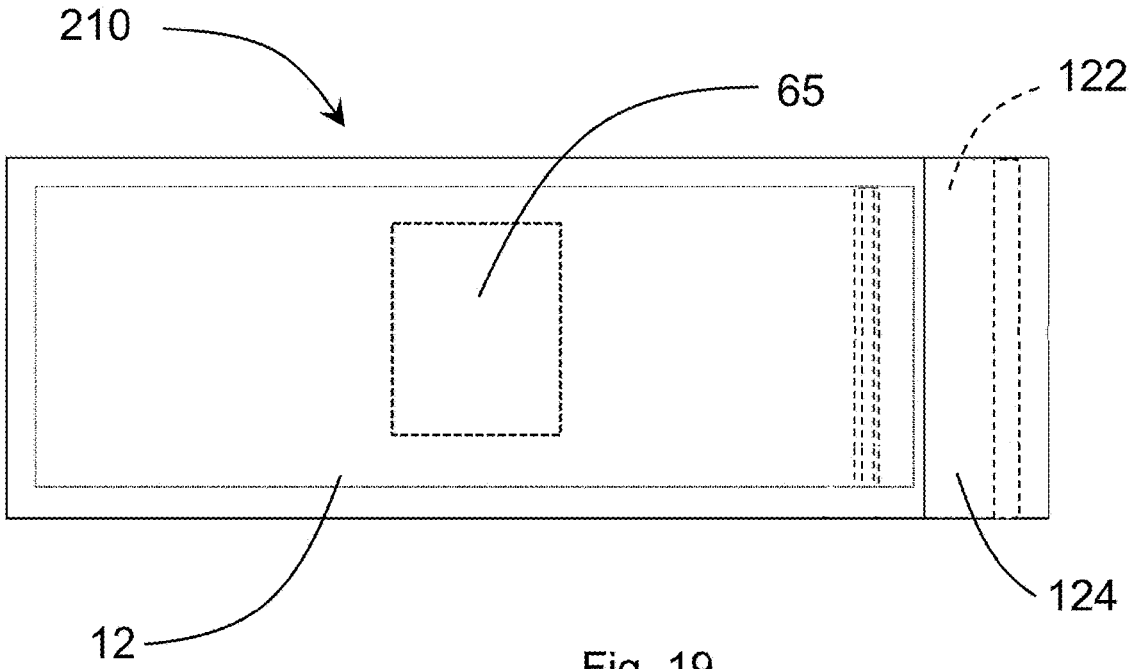
FIG. 19 shows an embodiment of the tubular device having an identification block printed on an outside surface.

FIG. 5B shows a stiffening means 40*c* can also be formed integrally from the barrier sleeve material, for example by folding or lapping of the sleeve material at the end a plurality of times, and sealing or affixing (including a heat, ultrasonic, and adhesive seal) the overlapped folds. FIG. 19 shows an embodiment of a barrier sleeve 210 similar to that shown in FIG. 4, wherein the lip 122 of the back panel 14 (not shown) is substantially the same in length (longitudinally away from the open end) as the lip 124 of the front panel 12. The barrier sleeve also includes an identification block (ID block) 65 on an outside surface of the front panel 12 of the barrier sleeve. The ID block 65 is printed on the outside surface using a compatible ink material. Typically, the color of the ink material is white, off-white, or some other light color, to allow any hand-written or other printed letter to be apparent, visible and easy to read. The user can record the paint color, date, and other details on the ID block, with a marking pen or pencil. The ink surface must be receptive to ink and pencil, allowing the ink or pencil to wet out and adhere to the surface.

Figure 6:
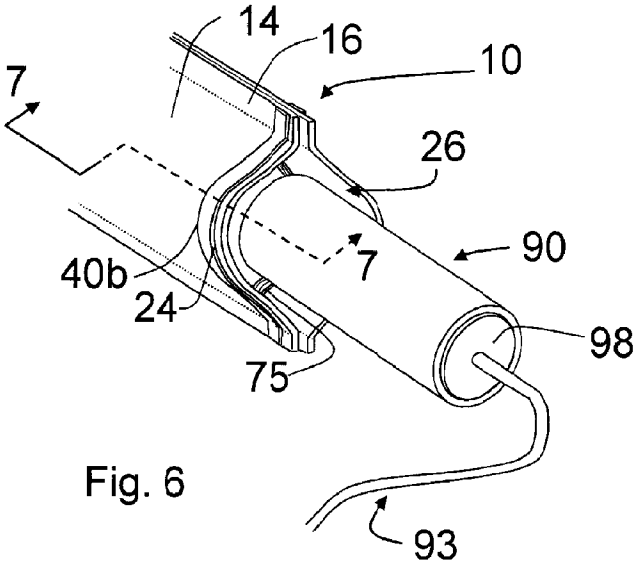
FIG. 6 shows a perspective view of a paint roller of FIG. 1 being inserted into the open end of the barrier sleeve of FIG. 4.

FIG. 6 shows the barrier sleeve 10 in its use as a storage container for a wet roller 90. A clean, unused barrier sleeve is taken and the lips at the open end are separated to form an opening into the container space. To widen the opening of the open end, force F is applied on the opposed ends of the stiffening means 40*a* and 40*b* (as shown in FIG. 3B), to provide sufficient clearance for insertion of the wet roller 90.

Figure 7:
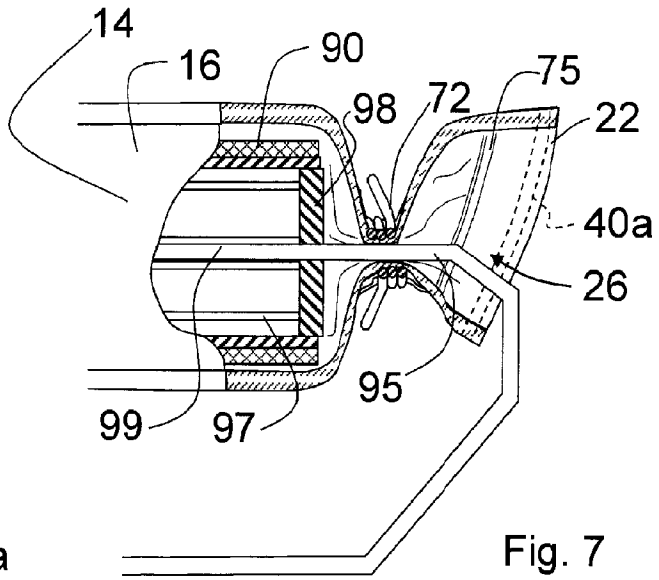
FIG. 7 shows a cross sectional view of the barrier sleeve of FIG. 6, viewed through line 7-7, where the roller is stored with the roller frame, and the barrier sleeve is gathered and sealed with a twist-tie.

When storing the roller on the frame, the frame handle and rod protrude from the open end of the sleeve. To form an effective seal for storage of the wet roller on-the-frame, a separate seal means is employed. As shown in FIG. 7, after the roller is inserted into the container space, the sleeve is gathered inboard the open end 26 (and inboard the stiffening means 40*a* and the optional plastic zipper 75, as illustrated) around the rod 95 of the paint frame. The gathered sleeve is then clasped tightly to the rod using the wire twist-tie 72. As shown, the twist-tie can be typically wrapped two or more times around the rod 95 to effect at least a vapor-resistant seal between the rod 95 and the barrier film. Other mechanical seal means can include a plastic strap with a ratcheting lock means for progressively tightening the loop of the strap around the barrier film and rod, and locking the tightened strap in position.

A suitable twist-tie has a wire size and number of wires sufficiently pliable to allow a compact, tight sealing of the opening, and sufficiently rigid to prevent unwinding of the tie when the twisting force is released. A typical one-wire twist-tie works well using a 21 gauge wire, and a typical two-wire twist-tie works well using a 24 gauge wire.

In an alternative embodiment, the sealing means 75 can be an adhesive seal, typically embodied as a strip of pressure-sensitive adhesive. The adhesive seal can be a continuous bead or strip of adhesive material. To prevent pre-mature adhesion or fouling of the adhesive surface, a release strip or substrate (not shown) can be placed over the adhesive seal, and can be removed during use. A second adhesive seal can be optionally disposed on the opposed inner surface of the front panel 14. After inserting the roller into the sleeve, the exposed adhesive seal on the back panel (the release paper having been removed after inserting the paint roller) is pressed tightly around and sealed to the handle rod, and to the inner surface of the confronting front panel.

Figure 8:
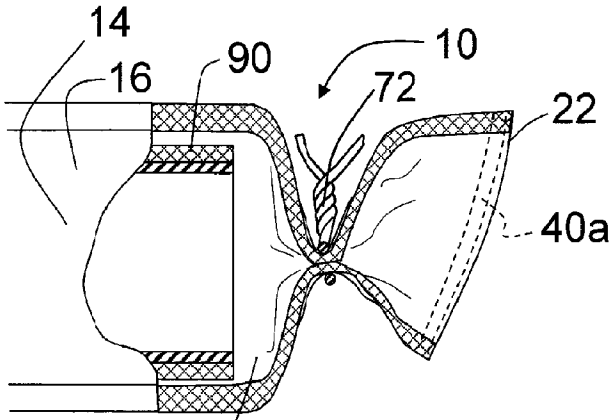
FIG. 8 shows the cross-sectional view of the FIG. 7, where the roller frame has been removed and the barrier sleeve sealed with a twist-tie.

In an off-the-frame storage configuration, the roller 90 is inserted into the container space of the barrier sleeve, and the roller frame 93 is withdrawn from the roller 90. The barrier sleeve itself provides a convenient means for grasping the outer surface of the paint roller 92 in one hand, while withdrawing the roller frame 93 with the other hand. After the roller frame is removed from the roller, the barrier sleeve, shown in partial cross section in FIG. 8, is sealed inboard of its open end 26 by gathering and twisting the film tightly, and compressing and securing the twisted film with a twist-tie 72.

Figure 9:
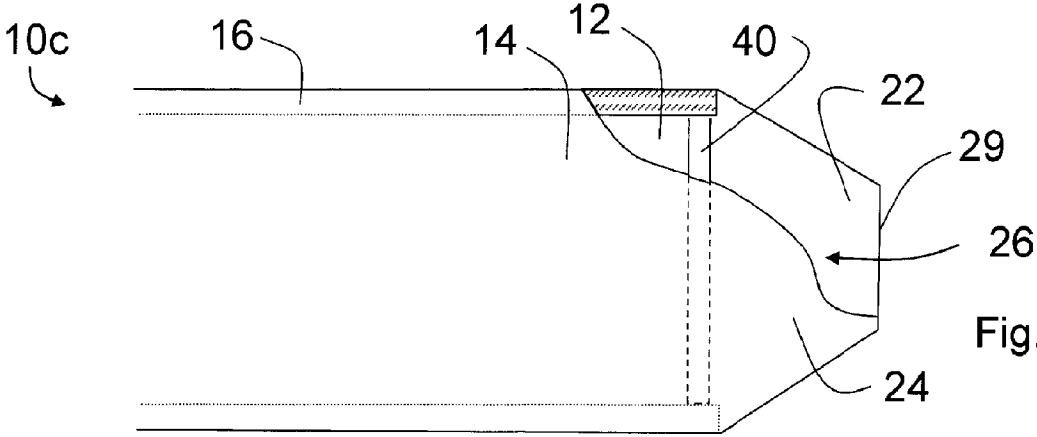
FIG. 9 shows an alternative embodiment of the barrier sleeve wherein the lip portion is tapered inward to its distal end.

FIG. 9 shows an alternative embodiment of the barrier sleeve 10*c* wherein the lip portions 22 and 24 that extend from the back and front panels 12 and 14, respectively, are tapered inward toward its distal end 29. The tapering shape can have straight or curves edges, can converge at a point, and/or can be provided with an aperture therethrough. Either one or both of the back and front lips 22 and 24 can be tapered.

Figure 10:
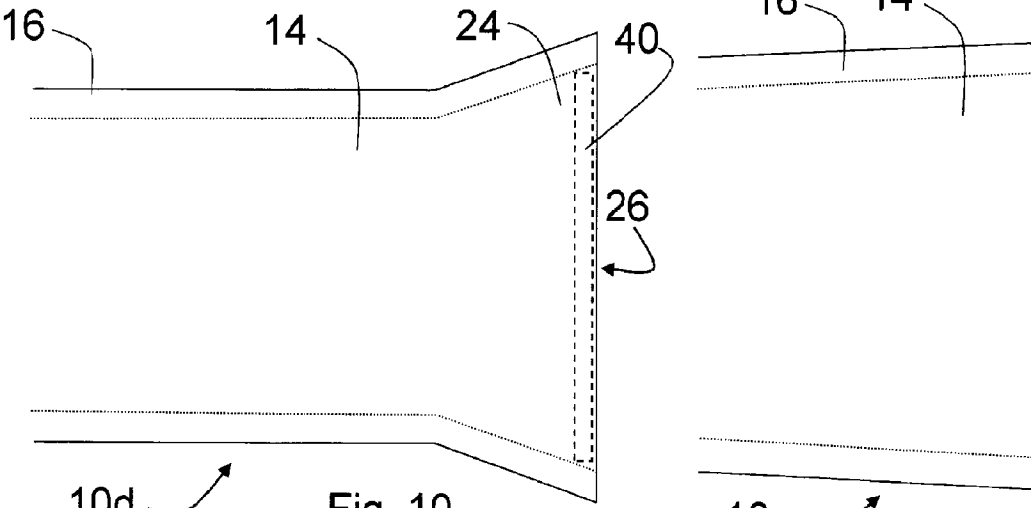
FIG. 10 shows another alternative embodiment of the barrier sleeve wherein the front and back panels are tapered along the side edges toward the open end.
Figure 11:
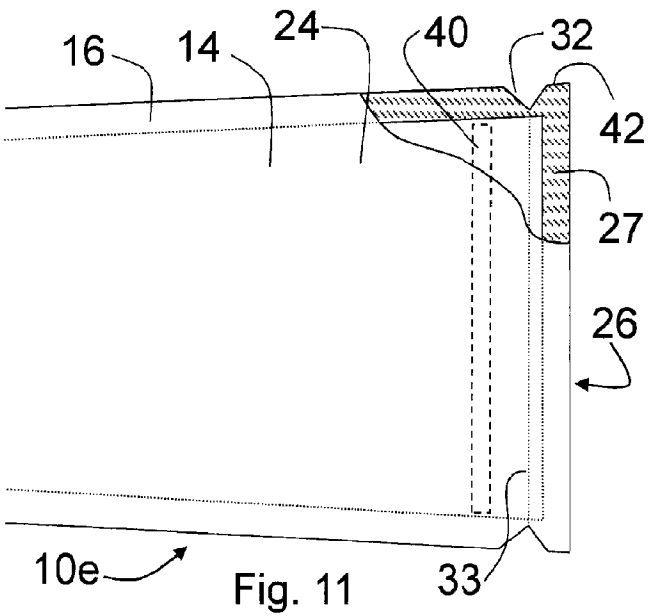
FIG. 11 shows another alternative embodiment of the barrier sleeve wherein the entire side lengths of the front and back panels are tapered toward the open end, and where the sleeve has a removable closure along the open end, and a means for removing the closure portion.

FIG. 10 shows another alternative embodiment of the barrier sleeve 10*d* wherein the front and back panels 12 and 14 are tapered toward the open end 26, to permit a larger open end 26 to simplify and improve insertion of the roller. The sleeve tapering can have straight or curves edges, and can diverge at any point and at any angle, along the sides 18. Either one or both of the back and front panels 12 and 14 can be tapered as described. FIG. 11 shows the barrier sleeve wherein the entire length of the front and back panels 12 and 14 are tapered outward toward the open end 26.

FIG. 11 also shows another embodiment of the barrier sleeve, wherein the sleeve, prior to use as a container for a paint roller, has a removable closure 27 along the open end, and a means for removing the closure portion along the open end, illustrated as at least one tear notch 32 formed in the side seal 16 in the side edge 42 of the back (and front) lip portion, and/or a tear line or line of weakness 33 formed in either or both lip portion of the barrier sleeve, that can facilitate removal of the sealed end portion, such as by tearing with the fingers. The tear line or line of weakness 33 can be a score line, a line of perforations, and other tear means.

Figure 12:
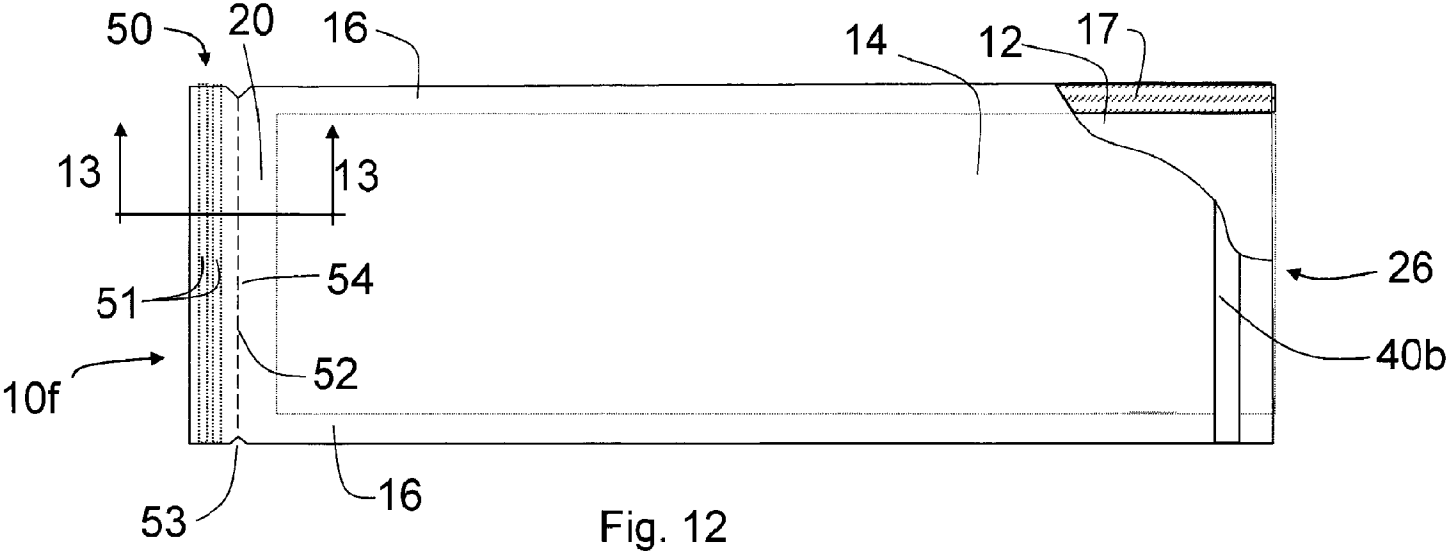
FIG. 12 shows an alternative embodiment of a barrier sleeve where a separable twist-tie is incorporated into the closed end of the barrier sleeve.
Figure 13:
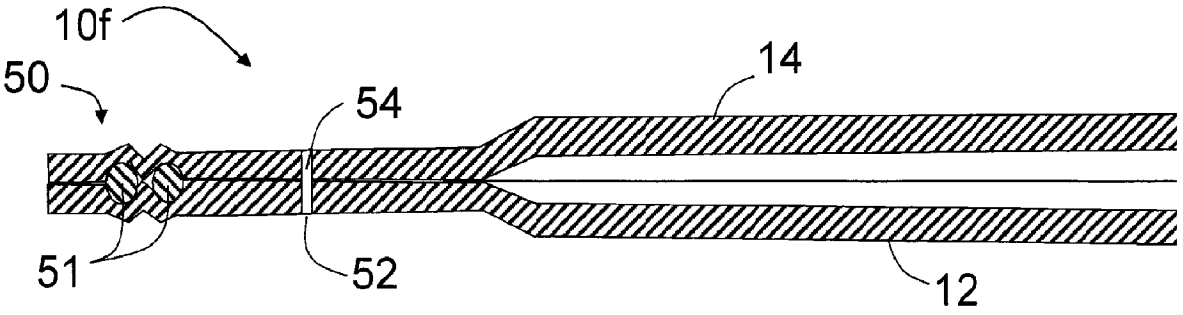
FIG. 13 shows a cross section of the barrier sleeve of FIG. 12 taken through line 13-13.

Another alternative embodiment of the barrier sleeve device 10*f* is shown in FIG. 12 wherein an integral mechanical sealing means is formed into an end of the barrier sleeve during manufacture. The illustrated sealing means 50 is a twist-tie that is separable from the main body of the barrier sleeve by a separating means illustrated as a tear line 52. The tear line is a line of perforations 54 along the tear line. The twist-tie 50 and the tear line 52 are shown formed into a portion of the closed end of the sleeve 10*f*. A pair (or one or marc) of wires 51 are captured between the laminated sheets 12 and 14, and are oriented perpendicular to the length dimension of the sleeve. The wires 51 extend the entire width of the sleeve, or a substantial portion of the width. The twist-tie 50 is typically formed in the machine direction during manufacturing, as described herein after. Edge notches 53 are formed along the edge of the sleeve at the tear line 52 to assist in initiating the separation of the twist-tie 50 along the tear line.

The separable twist-tie provides an efficient means for providing a consumer or user with a readily-available seal means to gather and compress the barrier sleeve material at the open end, without needing to locate a separate twist-tie.

The sealing means 50 with associated separating means 52 can also be formed at the open end 26 of the sleeve, thereby forming the removable closure along the open end, in which case the removable closure 27 in FIG. 11 is replaced with the sealing means 50 as a closure for the open end 26, separable along the tear line for removing the removable closure along the open end.

Figure 14:
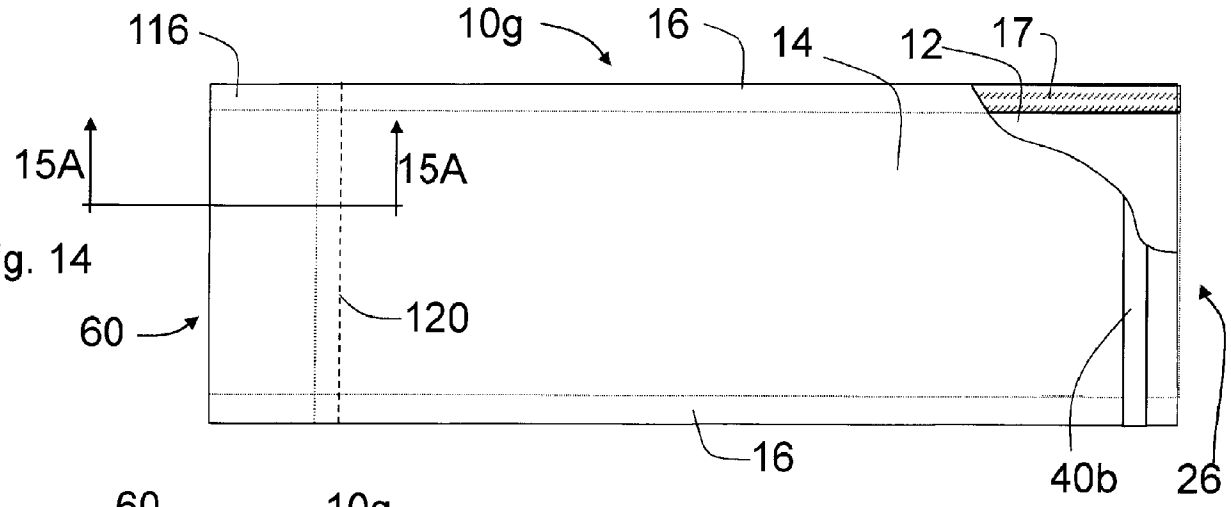
FIG. 14 shows an alternative embodiment of a barrier sleeve where the closed end is gusseted.
Figure 15A:
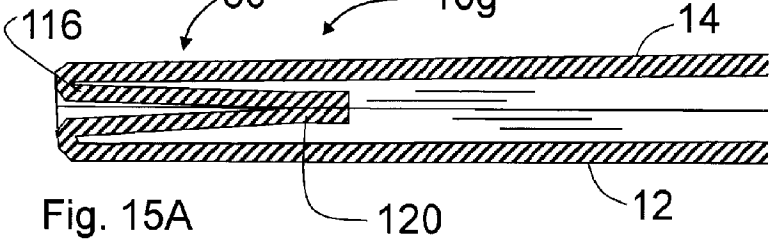
FIG. 15A shows a cross sectional view of the barrier sleeve of FIG. 14, taken through line 15A-15A.
Figure 15B:
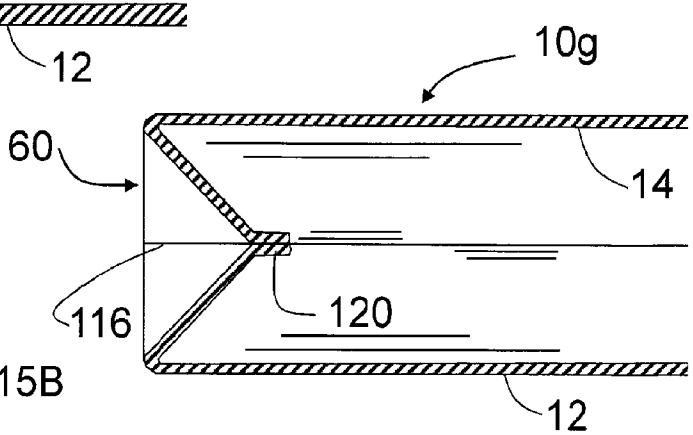
FIG. 15B shows the barrier sleeve of FIG. 15A with the gusseted end expanded.

Another embodiment of the barrier sleeve device 109 is shown in FIG. 14, where the closed end 120 is formed with a folded gusset 60. As shown in cross section in FIG. 15A, the end edges of the layers 12 and 14 are joined into the distal ends, and then inverted into the space between layers 12 and 14 to a distance of about 10% to about 50% of the width of the barrier sleeve. After inverting the closed end 120, the side edges 116 of the gusset 60 are sealed together. The sleeve 109 expands to provide both a base for standing the barrier sleeve on end, and a means to increase the void space within the sleeve near the closed end 120, as shown in FIG. 15B.

It is also within the scope of the present invention to provide a barrier device that provides a tubular barrier material that resembles a pouch, which has a longitudinal dimension and is sealed at each longitudinal end. The barrier pouch device has an opening along the longitudinal length of the tubular shape, through which the paint roller can be inserted and removed, and along which a seal means effects the vapor seal. The features of this embodiment are similar to those described hereinbefore with barrier sleeve devices.

The barrier sleeves 10 are formed by methods well known to those skilled in the art. The effective diameter and overall length of the sleeve is specified to allow sufficient spacing between the sides of the wet roller and the sides of the sleeve, and between the end of the roller and the opening, for insertion of the wet roller, and for gathering and sealing of the open end of the barrier sleeve around the paint roller or around the handle rod of the paint roller/frame assembly, as the case may be.

A typical method for forming the barrier sleeve with a film material employs a continuous processing machine that handles rolls of plastic film, stiffening means elements, and others. Typically, a pair of rolls of barrier film continuously unrolled in the machining direction, with one unrolling layer registered above the other unrolling layer. The lateral (side-to-side oriented) elements of the sleeve, such as the stiffening means, the plastic zipper, the wires for the separable twist-tie, are similarly supplied on rolls and are unrolled in the machine direction, and are aligned and registered with the barrier films in the required transverse position. The lateral elements are typically sandwiched and sealed between the two barrier film layers by sealing means, including heat seals, adhesive, ultrasonic seals, and the like. Alternatively, one or more of the transverse elements can be attached separately to either the outside or inside surface of either the top or bottom unrolling film, before the two unrolling films are joined, as needed. A machine-direction seal is formed at least along the closed end of the barrier sleeve. Any lines of perforations, such as the tear line, can be continuously formed in the machine direction. Spaced-apart side seals are typically formed by a pair of rotating drum seals, oriented on opposite sides of the laminated films, each having a rotational centerline oriented in the transverse direction, by means known in the art. The continuously formed barrier sleeves are then separated by a transverse cutting means, such as a rotating knife blade having a rotational centerline oriented in the transverse direction.

Vapor Transmission Rate

A barrier sleeve material of the present invention is considered an impermeable barrier material when the moisture transmission rate is about 1.0 grams/100 square inches/24 hours, and less, and when the solvent transmission rate is about 4.0 grams/100 square inches/24 hours, and less. These combined properties allow the impermeable barrier sleeve to prevent evaporation of most or all paint diluents (both water and most organic solvents) over a long period of time. The device has use with both latex- (water) based paints and coatings and with solvent-based paints (using mineral spirits or other organic solvents). Moisture barrier transmission rate properties of the barrier film are measured at 100 degrees F. and 90% RH. Solvent barrier transmission rate properties of the barrier film are measured at 85 degrees F. and 50% RH.

For the purpose of assessing the solvent transmission rate of a particular barrier film material, mineral spirits shall be used.

Vapor Transmission Rates are determined using the following procedure:

1. The test sheet or film material is cut into rectangular shapes and formed into rectangular, tour-sided pouches, by using a heat sealer to form three linear seals on three sides, and leaving one side open for filling. The two opposing seals are made 7.071 inches (18 cm) apart, measuring from the inside of the seal. The third linear seal is made at least 8 inches (20.3 cm) from the open end.

2. The pouch is filled with 20 ml of mineral spirits, or distilled water, and a fourth linear heat seal is formed along the open end after filling, so that the fourth linear seal and the seal opposite are spaced apart also by 7.071 inches (18 cm). This provides the pouch with a total material surface area of 100 square inches (645 $cm^2$).

3. The filled pouch is weighed to the nearest 0.01 gram as the initial filled weight.

4. The weighed, filled pouch is place in a cabinet maintained at 85° F. (29.4° C.) and 50% relative humidity (RH).

5. The pouches are weighed weekly for three weeks, at the same time as the initial weight was made, and calculate weight loss by subtracting 7-day weight from the initial weight (or the previous 7-day weight). The weight difference between the initial weight (or the previous 7-day weight) and the 7-day weight is the weight of the mineral spirits or water that passed through the material in that seven day period. Divide the weight difference number by seven to obtain the solvent or water vapor transmission rate in grams transmitted per 24 hour period per 100 square inches of material.

Barrier Materials

A barrier sleeve film that meets the moisture and solvent barrier requirements can include, but not be limited to, one or more of the following film components in a lamination or co-extrusion with a heat seal layer: polyester (PE), nylon (typically polyamide nylon), ethyl vinyl alcohol (EVOH), polyvinylidine chloride (PVDC), polyacrylonitrile (PAN), metalized (aluminum or other) nylon, metalized polyester, metalized polypropylene, aluminum oxide-coated polyethylene teraphthalate (PET), and silicon oxide-coated PET, aluminum- and/or silicon-oxide-coated polyester and polypropylene (PP). Specific barrier sleeve films include: PVDC, aluminum oxide-coated PET, metalized PET, silicon oxide-coated PET, laminates or co-extrudates of PE with one or more of the group consisting of nylon, EVOH, and PET, laminates and co-extrudates of PP with nylon, EVOH and PET, and metalized laminates or co-extrudates comprising PE or PP.

In addition to being impermeable to vapors, the barrier film is chemically resistant to solvent corrosion, and where laminates are used, the barrier film does not delaminate or separate.

The heat seal layer can include, but not be limited to, a material, typically in the form of a film, selected from the group consisting of polyolefin, including low density polyethylene (LDPE), high density polyethylene (HDPE) middle density polyethylene (MDPE), and high molecular weight high density polyethylene (HMWHDPE), ethyl vinyl acetate (EVA), acid copolymers, including ethylene/acrylic acid copolymer (EAA) and EMAA, amorphous polyester, ionomer, acid copolymer, and a polypropylene film or coating, and combinations and laminates thereof. The heat seal layer is typically a continuous solid layer that can adhere to the confronting layers of the opening of the sleeve. The heat seal layer is preferably void-free, and solvent resistant. Laminates or co-extrusions of the heat seal layer with the barrier material are well known to persons of ordinary skill in the art.

The barrier material used to make the body of the barrier pouch is available from a number of commercial suppliers of flexible packaging materials, including Clear lam, Printpack, Alcan, Amcor, and Bemis.

An alternative barrier film material has stable twist retention and dead-fold properties that allow the sleeve to be folded into a vapor-tight self-seal, or to be gathered and twisted around the handle rod of a roller to retain the seal without a separate sealing means such as a twist-tie or zip-tie. Examples of such materials include aluminum foil typically having a thickness of at least 0.006 mm, and up to about 0.200 mm, and a multilayer film comprising alternating layers of a first material and a second material, the first material comprising a ductile polymeric material having at least one distinct yield point, and the second material comprising a brittle polymeric material capable of fracturing upon the application of tensile stress, and the number of alternating layers being sufficient to cause the film to exhibit dead fold, creasing, and/or twistability characteristics. The first material is selected from the group consisting of polycarbonate, polyolefin, and nylon, and combinations and laminates thereof, and the second material is selected from the group consisting of polystyrene, styrene-acrylonitrile copolymer, and poly vinyl chloride (PVC), and combinations and laminates thereof, as described in U.S. Pat. No. 4,965,135, the disclosure of which is incorporated herein by reference.

Figure 16:
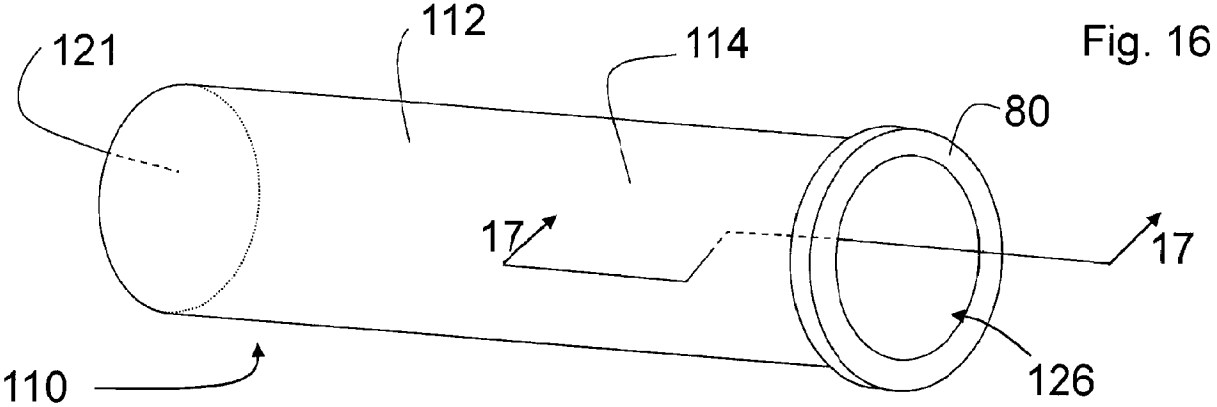
FIG. 16 shows a second embodiment of a thermoformed or blow molded tubular device of the present invention.

A second embodiment of the present invention provides a barrier device 110 shown in FIG. 16 as a thermoformed tubular sleeve 112 having a cylindrical sidewall 114 and a closed first end 121 for forming a cylindrical container space, and an opposed open end 126. The material of the thermoformed tubular sleeve 110 has sufficiently rigidity and shape memory to maintain normally a cylindrical shape. Typically the open end has a circular opening defined by a resilient thermoformed rim 80 having a thickness greater than the thickness of the thermoformed sidewalls, typically about ten times thicker, that has sufficient rigidity and shape memory to maintain the opening of the open end 126. The length-to-diameter ratio of the thermoformed tubular sleeve is typically at least 4:1, with a typical workable diameter of about 2 to 4 inches.

Figure 18:
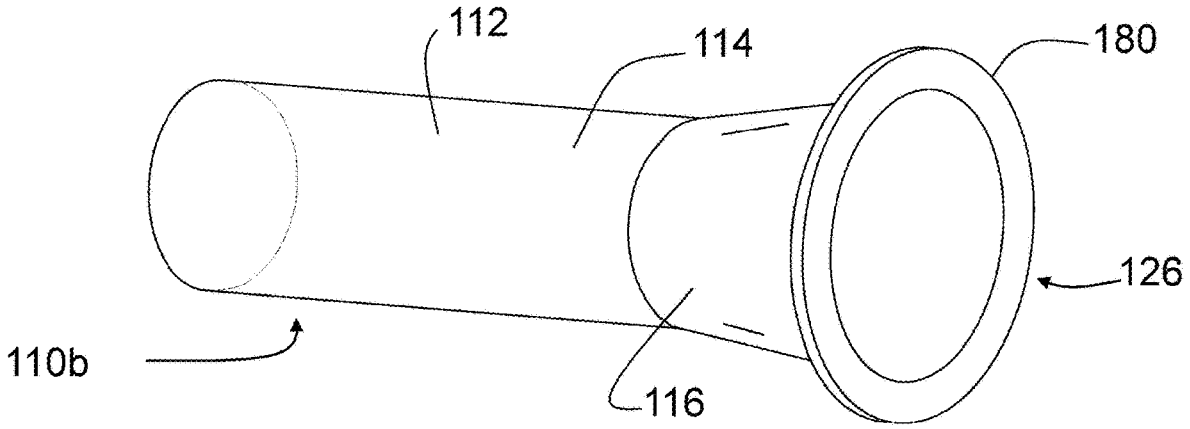
FIG. 18 shows an alternative embodiment of the tubular device where the tubular wall tapers outward toward the open end.

The sidewall 114 can be provided with an outwardly tapered portion 116, as shown in FIG. 18, to aid in the insertion of the roller.

Figure 17:
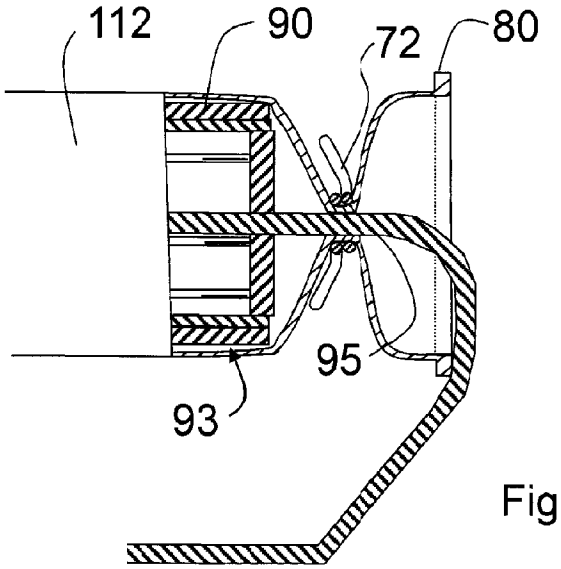
FIG. 17 shows a partial cross-sectional view of the thermoformed or blow molded tubular sleeve shown in FIG. 16 taken through line 17-17, after a paint roller mounted on the roller frame has been fully inserted into the tubular sleeve, with the barrier sleeve inboard of the open end being compressed against the rod of the roller frame with a twist-tie as a means of effecting a seal.

After a paint roller 90 mounted on a roller frame 93 is inserted into the container space of the thermoformed tubular sleeve 112, as shown in cross-section in FIG. 17, the device is typically sealable near the open end 126 to enclose the container space, typically by rotating the rim 80 relative to the cylindrical sidewall to gather the sidewall 114 inboard of the rim 80, in a manner similar to an iris valve. The gathering of the sidewall 114 around the rod 95 forms a vapor-resistant seal to vapor transmission along the rod and toward the open end 126. The gathered or twisted sidewall can be secured in position, and pressed tightly against the surface of the rod, by a twist-tie or other mechanical seal means.

The present invention also provides a method of using the barrier devices described herein for storing a wet paint or solvent roller for extended periods of time between usages. The barrier properties of the barrier film that provides an impermeable barrier to moisture and solvent, and the seal means, provides a container area within the device during storage, from which moisture and solvent vapor transmission is very low, enabling the storage of wet paint rollers within the device for weeks to months of time without hardening or thickening of the residual paint.

Since the device is designed to limit and inhibit moisture and solvent loss, through the barrier film or across the seal means, loss of moisture and solvent from the paint is very low. This encourages the user to place additional paint onto the roller, in order to provide a reserve of paint moisture or solvent, such that even moderation losses in moisture and solvent will not harden the paint and foul the paint roller.

The barrier sleeve having a thin barrier film that is impermeable to moisture and solvent, can be gathered tightly to the wet outer surface of the wet paint roller, which helps the user to force out any residual air within the container space, within which the paint solvent might evaporate, and which minimizes the amount of outside oxygen that might transfer into the closed sleeve to interact with the paint.

The method also includes the step of forming an effective seal against the transfer of moisture and solvent from within the container space, to the outside, typically through the open end. When using mechanical sealing means, the effectiveness of the seal is improved by twisting the open end of the sleeve tightly around the roller frame, and by wrapping the mechanical seal, such as the twist-tie, tightly around the sleeve and roller frame rod, to effect the seal. In an alternative method, the mechanical sealing means has dead fold properties, enabling the open end of the sleeve to be tightly gathered and compressed, in order to retain the seal after the manual twisting force is released.

EXAMPLES

Samples of various films and sheets were prepared and tested for water vapor and solvent vapor transmission rates in accordance with the procedure for VTR disclosed above. The vapor transmission rates for water and mineral spirits are provided below in Table A.

Results are listed in grams/100 square inches/24 hours.

TABLE A 7-day Vapor Transmission Rates *

| Film Material source | Category | Water | Mineral spirits ** |
|---|---|---|---|
| Kibbles ® Foil Lamination | Foil | 0.0043 | 0.0028 |
| Clearlam ® Gloss MET PET | MET PET | 0.0308 | 0.0101 |
| Clearlam ® Matte MET PET | MET PET | 0.0423 | 0.0042 |
| Silver Frack Pack | MET PET | 0.0453 | 0.019 |
| Coffee—Metal In | | | |
| MET PET/LLD—Duralam | MET PET | 0.0342 | 0.0064 |
| Fruity Pebbles ® Box Liner | HDPE-Nylon | 0.0353 | 0.0001 |
| Ruffles ® PP/PE/METWPP | MET PET | 0.0001 | 0.0126 |
| Saran ® Wrap—40 ga | PVDC | 0.2041 | 0.0001 |
| Camera Overwrap Film | SIOX PET | 0.0306 | 0.007 |
| Orange Balloons—Met BON | MET Nylon | 0.3537 | 0.0135 |
| Silver Balloons—Glenroy | MET Nylon | 0.3537 | 0.0106 |
| Hormel ® 1 lb Classic Bacon | N-EVOH | 0.5647 | 0.0179 |
| Blue Ribbon Footlong | N-EVOH | 0.5495 | 0.0058 |
| 48 ga 850 H H.S. PET | PET | 1.3600 | 0.0001 |
| Playtex ® Baby Bottle Liner | | 0.1833 | 7.9+ |
| 2.5 LLD Ziploc ® Bags | LLDPE | 0.1498 | 5.9+ |
| 18% VA Content Film—5 mils | EVA | 0.8829 | 6.6+ |
| Corn Flakes ® Box Liner—2 mil | HDPE-EVA | 0.0870 | 5.0012 |
| 95 ga Hefty ® Cinch Sack | HDPE | 0.5610 | 7.4+ |
| 1.25 LLD Printpack ® Bags | LLDPE | 0.3395 | 8.8+ |
| Drycleaner Bags—80 ga | HDPE | 0.5602 | 7.2+ |

TABLE A-continued 7-day Vapor Transmission Rates *

| Film Material source | Category | Water | Mineral spirits ** |
|---|---|---|---|
| Kroger ® Grocery Bags—50 g | HDPE | 1.1100 | 7.6+ |
| 30 ga Grocery Store Produce Bags | HDPE | 0.7618 | 10.1+ |
| Surlyn ® 4 mil 1601 Blown Film | Ionomer | 0.2065 | 6.7991 |
| 2 mil Barex ® Film—June 1995 | Barex | 1.4000 | 0.0083 |
| 100 ga Dupont ® F 101 Nylon Film | Nylon | 17.6000 | 0.4363 |
| Pepperidge Farms ® 120 OPP Flow Wrap | PP | 0.1631 | 7.3+ |
| 2 mil PE-PP-PE Printpack ® Film | PE-PP-PE | 0.2642 | 8.7+ |
| 1 Mil PE-PP-PE Printpack ® Film | PE-PP-PE | 0.2437 | 7.7+ |
| Cocoa Puffs ® Box Liner 3.1 mil | HDPE | 0.0801 | 5.4 |
| Mike Sells ® PP/PE/PP Snack Bags | PP | 0.1180 | 6.5+ |
| Kroger ® Puffed Rice Bags | PP-PE | 0.1966 | 7.9+ |
| Mike Sells ® PP/PE/METPP Bags | MET OPP | 0.0682 | 13.2 |
| Hussmanns ® PP/PE/METPP Bags | MET PET | 0.0099 | 7.5 |
| Gardetto's ® PP/PE/METPP Bags | MET PET | 0.0001 | 14.5 |

* grams/100 square inches/24 hr

** Low Odor Version

While the invention has been disclosed by reference to the details of preferred embodiments of the invention, it is to be understood that the disclosure is intended in an illustrative rather than in a limiting sense, as it is contemplated that modifications will readily occur to those skilled in the art, within the spirit of the invention and the scope of the appended claims.

I claim:

1. A vapor barrier device for storing a wet paint application device, comprising:

a) a barrier sleeve made from a barrier film, comprising a front panel having a rectangular shape and opposed long sides, and a back panel having a rectangular shape in registry with the front panel, and having opposed long sides that are joined along a portion of the respective opposed long sides of the front panel, and having a closed end to define a container space for storing a wet paint application device, and having an opening at an open end into the container space, wherein the front panel includes a front lip having side edges extending from the opening along the opposed long sides at the open end, the front lip adapted to be folded against the front panel, and the back panel includes a back lip having side edges extending from the opening along the opposed long sides at the open end, the back lip adapted to be folded against the back panel, wherein the side edges of the front lip are not affixed to the side edges of the back lip; and b) a first stiffening strip disposed on the front lip, the first stiffening strip having opposed ends that extend to the side edges of the front lip, and a second stiffening strip disposed on the back lip, the second stiffening strip having opposed ends that extend to the side edges of the back lip, to assist a user in biasing open the opening with the front lip folded against the front panel and the back lip folded against the back panel, for inserting the wet paint application device through the opening and into the container space, wherein the first and second stiffening strips are made of a resilient material having sufficient flexibility and pliancy to be manipulated into a bent or curved shape opposed forces are applied to the respective opposed ends of the first and second stiffening strips, and having sufficient resilience and shape memory to bias back from the bent or curved shape when the opposed forces are removed.

2. The device according to claim 1, further including an identification block printed on an outside surface of at least one of the front panel and the back panel of the barrier sleeve.

3. The device according to claim 1, wherein the barrier film is selected from the group consisting of a plastic film, a metalized plastic film, a metal film or foil, and combinations and laminates thereof.

4. The device according to claim 1, wherein the barrier sleeve is selected from the group consisting of a pair of confronting flexible layers of barrier film joined along a periphery seal.

5. The device according to claim 1 wherein the resilient strips are affixed on the inner surface of the barrier sleeve.

6. The device according to claim 1 further including a seal means, associated with the barrier sleeve, for forming a seal along the open end of the barrier sleeve, wherein the seal formed by the seal means comprises at least one of an air-resistant, moisture-resistant, and solvent-resistant seal.

7. The device according to claim 6, wherein the seal means is integral with the barrier sleeve and disposed proximate the open end of the barrier sleeve, and is selected from the group of a reclosable plastic zipper, an adhesive disposed on a surface of at least one of the front lip and the back lip, and a compression seal means, and combinations thereof.

8. The device according to claim 1, wherein the first resilient strip and second resilient strip comprise a flat band made of a plastic material.

9. The device according to claim 8 wherein the plastic flat bands are adhered to the respective front lip and back lip with an adhesive means or a heat seal, the adhesive means selected from the group consisting of polyethylene (PE), ethyl vinyl acetate (EVA), amorphous polyester, ionomer, acid copolymer, polypropylene film, pressure-sensitive adhesive, and pressure-sensitive adhesive tape, and combinations thereof, and the heat seal comprising a layer of polyethylene or other heat seal material heat-sealed to the sleeve film of the respective front lip and back lip.

10. The device according to claim 1, wherein the barrier film is impermeable to moisture vapor.

11. The device according to claim 10, wherein the barrier film is further impermeable to solvent vapor.

12. The device according to claim 1, wherein the barrier film is impermeable to solvent vapor.

13. The device according to claim 1, wherein the barrier film has a thickness of 4 mil and less.

* * * * *